US008723437B1

(12) United States Patent
Wang et al.

(10) Patent No.: US 8,723,437 B1
(45) Date of Patent: May 13, 2014

(54) FILTER BANDWIDTH ADJUSTMENT IN A MULTI-LOOP DIMMER CONTROL CIRCUIT

(71) Applicant: iWatt Inc., Campbell, CA (US)

(72) Inventors: Xiaoyan Wang, Milpitas, CA (US); John William Kesterson, Seaside, CA (US); Clarita C. Poon, Pleasanton, CA (US); Guang Feng, Cupertino, CA (US); Haiju Li, Fremont, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 0 days.

(21) Appl. No.: 13/710,230

(22) Filed: Dec. 10, 2012

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 41/16*** | (2006.01) |
| ***H05B 41/24*** | (2006.01) |
| ***G05F 1/00*** | (2006.01) |

(52) U.S. Cl.
USPC ..... 315/224; 315/291; 315/279

(58) Field of Classification Search
USPC ..... 315/224, 223, 291, 171, 227, 279, 246, 315/307
See application file for complete search history.

(56) References Cited

U.S. PATENT DOCUMENTS

| | | | | |
|---|---|---|---|---|
| 6,577,512 | B2 * | 6/2003 | Tripathi et al. | 363/21.17 |
| 7,262,559 | B2 * | 8/2007 | Tripathi et al. | 315/291 |
| 8,466,628 | B2 * | 6/2013 | Shearer et al. | 315/209 R |
| 8,492,988 | B2 * | 7/2013 | Nuhfer et al. | 315/246 |
| 8,553,431 | B2 * | 10/2013 | Zheng | 363/21.12 |
| 2010/0033095 | A1 * | 2/2010 | Sadwick | 315/51 |
| 2011/0267375 | A1 * | 11/2011 | Yang et al. | 345/690 |
| 2013/0020964 | A1 * | 1/2013 | Nuhfer et al. | 315/291 |

* cited by examiner

*Primary Examiner* — Alexander H Taningco
*Assistant Examiner* — Dylan White
(74) *Attorney, Agent, or Firm* — Fenwick & West LLP

(57) ABSTRACT

The embodiments disclosed herein describe the adjusting of filter bandwidths in a multi-loop LED dimmer control circuit based on received dimmer input signals. The bandwidth of a filter in an active loop (a loop driving an LED power circuit) is decreased to prevent signal noise and associated LED flickering. Likewise, the bandwidth of a filter in an inactive loop (a loop not driving the LED power circuit) is increased to a pre-determined maximum in order to improve response time and decrease potential overshoot or undershoot during dimmer adjustment.

19 Claims, 4 Drawing Sheets

FILTER BANDWIDTH ADJUSTMENT IN A MULTI-LOOP DIMMER CONTROL CIRCUIT

BACKGROUND

1. Field of Technology

Embodiments disclosed herein relate generally to LED operation and more specifically to filter bandwidth adjustment in a multi-loop LED dimmer control circuit.

2. Description of the Related Arts

Dimmable LED drivers generally perform two functions: regulating the LED load current based on a dimmer signal describing a level of LED brightness, and providing a constant load current if the dimmer signal describes a maximum level of brightness. In one implementation, a dimmer signal can directly modify a reference current in an LED load current control loop such that the load current varies with changes in the dimmer signal. However, in order to maintain stability in such an implementation, the bandwidth in the LED load current control loop is limited. As a result, the dimming response can be sluggish, for instance upon a rapid dimmer level adjustment.

To improve dimming response performance, the dimmer signal can instead influence a pulse-width-modulation ("PWM") generator configured to drive an LED power circuit. In such an embodiment, a current reference signal can be used to drive the power circuit when the dimmer signal describes a maximum level of brightness. Switching between driving the power circuit based on the dimmer signal and the current reference can also be sluggish, and may result in overshoot or undershoot of LED load current provided by the power circuit. While the power circuit will correct the load current overshoot or undershoot eventually, the LED itself can flicker or produce other undesirable effects in the meantime as a result of the sporadic load current behavior.

SUMMARY OF THE INVENTION

The embodiments disclosed herein describe the setting and adjustment of filter bandwidths associated with operating loops in a multi-loop dimmer control circuit. The dimmer control circuit can include a dimmer loop configured to receive a dimmer output signal from a dimmer switch (such as an adjustable dimmer knob). In response to receiving a dimmer output signal, the dimmer loop generates a first loop signal representative of the dimmer output signal. The dimmer control circuit can also include a constant current loop configured to receive a sense signal representing a load current through an LED and a reference signal representing a full load current through the LED. The constant current loop generates a second loop signal representative of the sense signal and the reference signal.

Each dimmer circuit loop includes a filter. The filter can be a low-pass filter with a configurable bandwidth. The dimmer circuit can also include a signal generator, such as a pulse-width modulation generator. The signal generator is configured to generate driving signals for an LED power circuit based on the smaller of the first loop signal and the second loop signal.

When one of the dimmer or the constant current loop is driving the signal generator, the bandwidth of the driving loop filter is reduced, for instance to a pre-determined minimum, in order to reduce loop signal noise and potential LED flickering. At the same time, the bandwidth of the non-driving loop (or inactive loop) filter is increased to a pre-determined maximum, in order to improve response time and reduce potential overshoot or undershoot during dimmer adjustment.

When a dimmer output signal is received indicating a requested increase in brightness while the dimmer loop is driving the signal generator, the dimmer control circuit can increase the dimmer loop filter bandwidth while maintaining the constant current loop filter bandwidth. When the requested increase in brightness causes the first loop signal to be larger than the second loop signal, the dimmer control circuit switches from dimmer loop operation to constant current loop operation, increases the dimmer loop filter bandwidth to a pre-determined maximum and decreases the constant current loop bandwidth from a pre-determined maximum.

Similarly, when a dimmer output signal is received indicating a requested decrease in brightness while in constant current loop operation, the dimmer control circuit can increase the constant current loop filter bandwidth while maintaining the dimmer loop filter bandwidth. When the requested decrease in brightness causes the second loop signal to be larger than the first loop signal, the dimmer control circuit switches from constant current loop operation to dimmer loop operation, increases the constant current loop bandwidth to a pre-determined maximum and decreases the dimmer loop bandwidth from a pre-determined maximum.

The features and advantages described in the specification are not all inclusive and, in particular, many additional features and advantages will be apparent to one of ordinary skill in the art in view of the drawings and specification. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments disclosed herein can be readily understood by considering the following detailed description in conjunction with the accompanying drawings.

DETAILED DESCRIPTION OF EMBODIMENTS

The Figures (FIG.) and the following description relate to various embodiments by way of illustration only. It should be noted that from the following discussion, alternative embodiments of the structures and methods disclosed herein will be readily recognized as viable alternatives that may be employed without departing from the principles discussed herein.

Reference will now be made in detail to several embodiments, examples of which are illustrated in the accompanying figures. It is noted that wherever practicable similar or like reference numbers may be used in the figures and may indicate similar or like functionality. The figures depict various embodiments for purposes of illustration only. One skilled in the art will readily recognize from the following description that alternative embodiments of the structures and methods illustrated herein may be employed without departing from the principles described herein.

Embodiments disclosed herein describe the setting and adjusting of loop bandwidths by setting and adjusting the bandwidths of filters associated with the loops in a dimmer control circuit. In one embodiment, the filter bandwidth associated with an active loop (a loop driving an LED power circuit) is decreased, and the filter bandwidth associated with an inactive loop (a loop that is not driving the LED power circuit) is increased. Decreasing the filter bandwidth associated with an active loop can allow the dimmer control circuit to better reduce flickering associated with signal noise within the active loop. Increasing the filter bandwidth associated with an inactive loop can allow the dimmer control circuit to better improve response time, and can reduce signal overshoot or undershoot during an LED brightness adjustment. It should be noted that other loop components can affect a loop's bandwidth, but for the purposes of simplicity, the remainder of the description herein is limited to the setting and adjusting of filter bandwidth for the purposes of setting and adjusting loop bandwidth.

Figure 1:
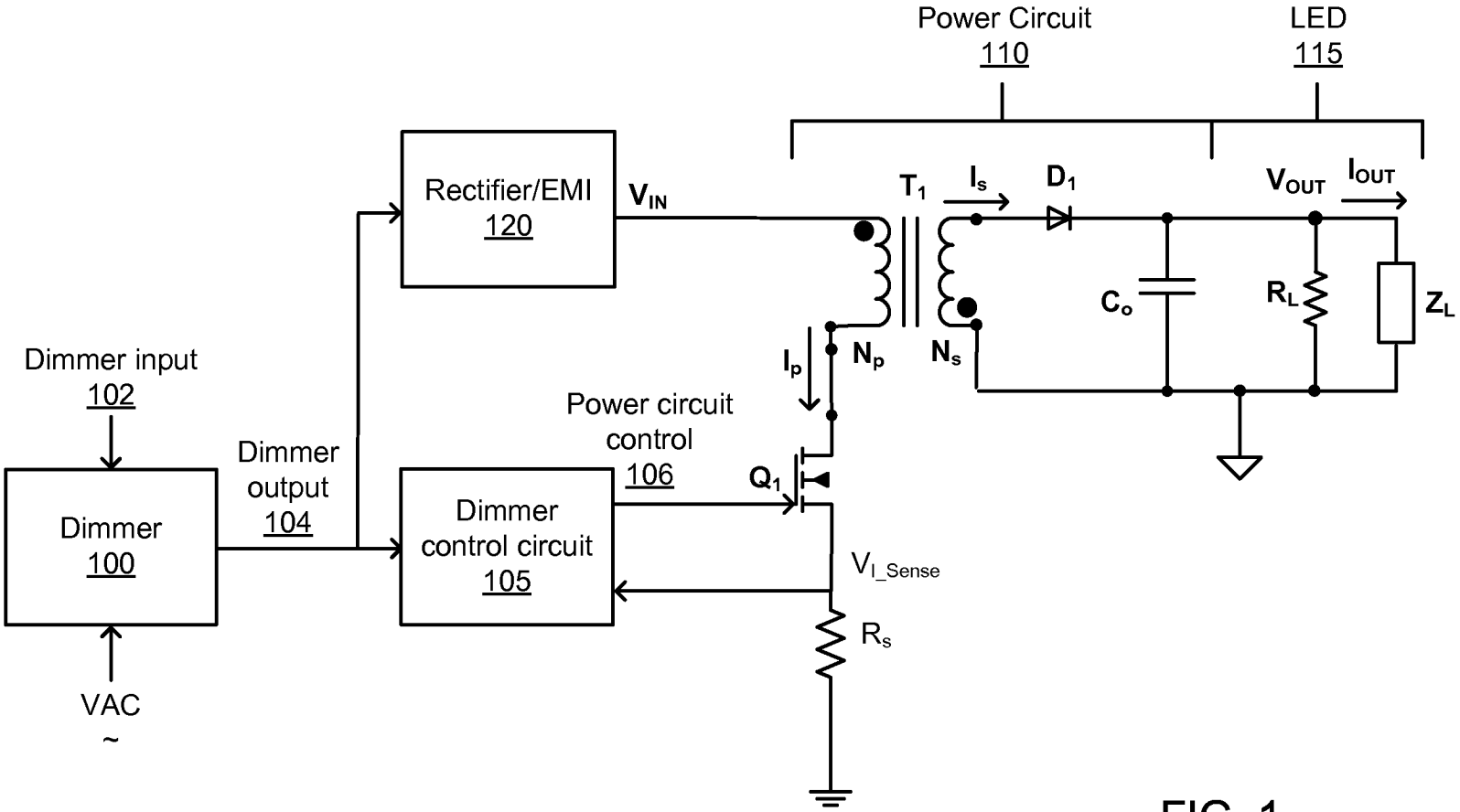
FIG. 1 illustrates dimmer circuitry configured to operate an LED lamp, according to one embodiment.

FIG. 1 illustrates dimmer circuitry configured to operate an LED lamp, according to one embodiment. The dimmer circuitry of FIG. 1 includes a dimmer 100, a dimmer control circuit 105, a power circuit 110, and an LED lamp 115 (hereinafter, "LED"). The dimmer receives an AC input voltage signal VAC and a dimmer input signal 102 representing a desired level of brightness for the LED. In response to receiving the dimmer input signal, the dimmer outputs a dimmer output signal 104 representative of the dimmer input signal by adjusting the RMS voltage value of the dimmer output signal in response to the dimmer input signal. The intensity of light produced by the LED is based on the dimmer output signal and represents the desired level of brightness. Accordingly, increases and decreases in the RMS voltage value of the dimmer output signal cause associated increases and decreases in the brightness of the LED, resulting in dimming up and dimming down effects by the LED.

The dimmer 100 can be a conventional dimmer switch, and the dimmer input 102 can be provided manually (via an adjustable knob or slider switch, not shown herein) or via an automated lighting control system (not shown herein). One example of a dimmer is described in U.S. Pat. No. 7,936,132, the contents of which are incorporated by reference in their entirety. In one embodiment, the dimmer employs phase angle switching of the dimmer input to adjust the dimmer output 104 by using a TRIAC circuit. As used herein, a TRIAC is a bidirectional device that can conduct current in either direction when it is triggered. For the internal timing of a TRIAC dimmer to function properly, current must be drawn from the dimmer at certain times. In one embodiment, the LED is configured to draw current from the dimmer via the dimmer control circuit 105 and the power circuit 110 in a manner that allows the internal circuitry of the dimmer 100 to function properly.

The dimmer control circuit 105 receives the dimmer output 104 from the dimmer 100 and generates a power circuit control signal 106 for the power circuit 110 based at least in part on the dimmer output signal. The power circuit control signal causes the power circuit to power the LED based on the dimmer input signal 102. The dimmer control circuit is described in greater detail below in conjunction with FIG. 2.

The power circuit 110 of the embodiment of FIG. 1 is a flyback-type AC-DC switching power converter. In other embodiments not discussed further herein, the power circuit can be other types of power converters, driving circuits, and the like. The power circuit of FIG. 1 powers the LED 115 based on the power circuit control signal 106, and includes a transformer $T_1$, diode $D_1$, a capacitor $C_o$, and a power MOSFET switch $Q_1$. The power circuit receives the power circuit control signal 106, which drives the switch $Q_1$. The dimmer output signal 104 is received by the rectifier/EMI circuit 120, which rectifies the dimmer output signal to generate the regulated DC input voltage $V_{IN}$. The input power is stored in the transformer $T_1$ while the switch $Q_1$ is turned on, because the diode $D_1$ becomes reverse biased when the switch $Q_1$ is turned on. The rectified input power is then transferred to the LED load $Z_L$ across the capacitor $C_o$ while the switch $Q_1$ is turned off, because the diode $D_1$ becomes forward biased when the switch $Q_1$ is turned off. Diode $D_1$ functions as an output rectifier and capacitor $C_o$ functions as an output filter. The resulting regulated output voltage $V_{OUT}$ is delivered to the load $Z_L$. The resistor $R_L$ of the LED is a pre-load resistor that is typically used for stabilizing the output at no-load conditions.

The voltage signal $V_{I_SENSE}$ is used to sense the primary current $I_p$ through the primary winding $N_p$ and switch $Q_1$ in the form of a voltage across the sense resistor $R_S$, and is reflective of the load current $I_{OUT}$ through the LED 115. The voltage signal $V_{I_SENSE}$ is compared by the dimmer control circuit 105 to a reference voltage signal in a constant current loop during various modes of operation, as will be discussed below in greater detail in conjunction with FIG. 2.

Figure 2:
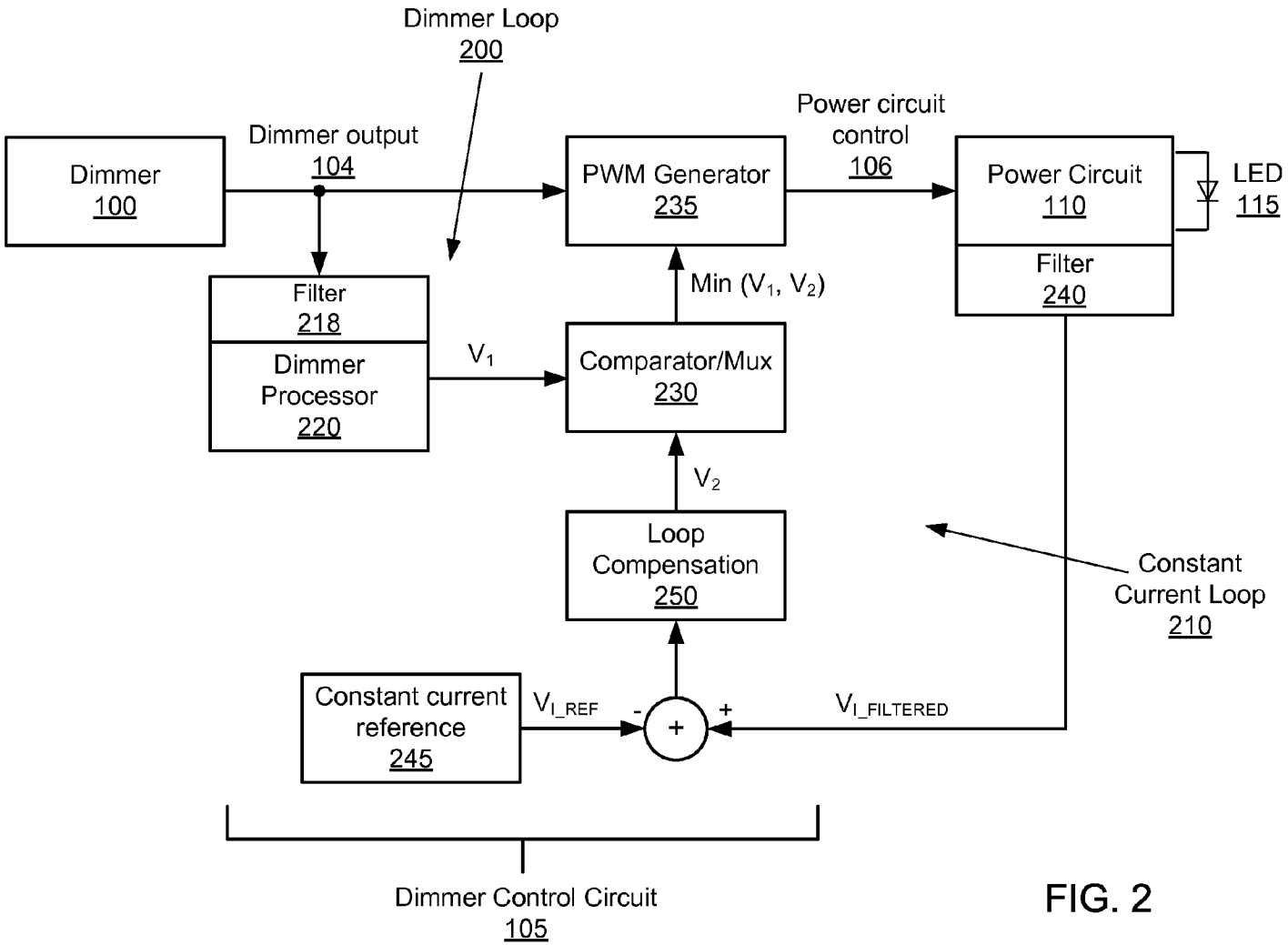
FIG. 2 illustrates a block diagram of a multi-loop dimmer control circuit, according to one embodiment.

FIG. 2 illustrates a block diagram of a multi-loop dimmer control circuit 105, according to one embodiment. The dimmer control circuit of FIG. 2 is coupled to the dimmer 100 and the power circuit 110 shown in FIG. 1, which powers the LED 115. The dimmer control circuit includes two control loops, a dimmer loop 200 and a constant current ("CC") loop 210. The dimmer loop drives the power circuit, and accordingly the LED, during low- and medium-brightness levels of LED operation as described herein. The CC loop drives the power circuit during high-brightness levels of operation of the LED.

The dimmer control circuit 105 includes a dimmer processor 220, a comparator/multiplexor ("mux") 230, a PWM generator 235, a constant current reference module 245, and a loop compensation module 250. The input of the dimmer processor 220 is coupled to a filter 218, and the output of the power circuit 110 is coupled to a filter 240. Other embodiments not discussed further may include additional, fewer, or different components than those described herein.

The filter 218 receives the dimmer output signal 104 from the dimmer 100 and generates a filtered dimmer output signal. As described herein, the filter 218 is a low-pass filter with a configurable-width passband, though in other embodiments, other types of filters can be used. The width of the passband is referred to herein as the "bandwidth" of the filter 218. The filter 218 filters the dimmer output signal such that portions of the dimmer output signal outside of the passband are substantially reduced in amplitude. Filtering portions of the dimmer output signal outside of the passband allows the filter 218 to reduce noise on the dimmer loop signal that may lead to perceivable LED flickering. Accordingly, decreased filter bandwidth can increase noise reduction, and vice versa.

The dimmer processor 220 receives the filtered dimmer output signal from the filter 218 and generates a processed dimmer output signal or dimmer loop signal, $V_1$. The dimmer processor includes a phase detector that generates a dimming phase signal representing an amount of phase modulation (if any) detected in the filtered dimmer output signal (e.g., between 0% and 100%). Based on the dimming phase signal, the dimmer processor determines a dimming ratio representing a fraction of power to deliver to the LED to achieve a desired level of brightness. In one embodiment, the dimmer processor uses a dimming ratio map that maps dimming phase signals to predetermined dimming ratios in order to determine the dimming ratio based on the dimming phase signal. The dimmer processor then generates a dimmer loop signal $V_1$ representative of the dimming ratio. For example, if the dimming ratio is 1, the dimmer processor generates $V_1$ configured to result in a luminosity response from the LED equivalent to 100% of the LED's potential luminosity, and if the dimming ratio is 0.3, the dimmer processor generates $V_1$ configured to result in a luminosity response from the LED equivalent to 30% of the LED's potential luminosity.

Similar to the filter 218, the filter 240 as described herein is a low-pass filter with a configurable-width passband, though in other embodiments, other types of filters can be used. The dimmer control circuit 105 detects the voltage signal $V_{I_SENSE}$ from across the resistor $R_S$ as illustrated in FIG. 1. The filter 240 filters the voltage signal $V_{I_SENSE}$ to generate the voltage signal $V_{I_FILTERED}$ as illustrated in FIG. 2. As with the filter 218, the bandwidth of the filter 240 is associated with the amount of noise reduction of the filter 240, where smaller bandwidth correlates to greater noise reduction and vice versa.

The voltage signal $V_{I_FILTERED}$ is compared to a reference voltage signal $V_{I_REF}$ generated by the CC reference module 245. The CC reference module outputs a voltage signal $V_{I_REF}$ representative of a voltage signal $V_{I_SENSE}$ that would result from an LED load current $I_{OUT}$ (and relatedly, a primary current $I_P$) associated with operating the LED at 100% luminosity. In other words, the voltage signal $V_{I_REF}$ represents the full-load voltage signal $V_{I_SENSE}$ across the sense resistor $R_S$. The voltage signal $V_{I_REF}$ can increase or decrease based on the operating parameters of the dimmer control circuit 105.

As illustrated in FIG. 2, the voltage signals $V_{I_FILTERED}$ and $V_{I_REF}$ are compared by subtracting the voltage signal $V_{I_REF}$ from the voltage signal $V_{I_FILTERED}$ and providing the difference to the loop compensation module 250, though in other embodiments, other types of comparisons can be performed, and/or the loop compensation module can directly receive and compare both voltages. The loop compensation module generates a comparison signal or CC loop signal $V_2$ based on the comparison of $V_{I_REF}$ and $V_{I_FILTERED}$. In one embodiment, the loop compensation module is a PI controller, though in other embodiments, the loop compensation module can be a comparator, an operational amplifier, or any other component configured to output a signal indicative of the difference between two voltage signals.

The comparator/mux 230 receives the loop signals $V_1$ and $V_2$, compares the signals, and outputs the smaller of the two signals, represented as "Min($V_1$, $V_2$)" in the embodiment of FIG. 2. In one embodiment, the comparator/mux includes both a comparator and mux configured to receive both $V_1$ and $V_2$. In such an embodiment, the comparator is configured to output the identity of the smaller signal on a comparison line, which is coupled to the select line of the mux, causing the mux to output the smaller of the two signals. The selected signal is used by the PWM generator 235 in generating power circuit control signals 106 for the power circuit 110. Accordingly, the generation of power circuit control signals based on the signal $V_1$ is referred to as "dimmer loop operation," as the LED is being driven by the dimmer loop signal $V_1$. Similarly, the generation of power circuit control signals based on the signal V2 is referred to as "CC or closed circuit loop operation," as the LED is being driven by the CC loop signal $V_2$.

The PWM generator 235 receives the dimmer output signal 104 and the smaller of the two signals $V_1$ and $V_2$ and generates power circuit control signals 106 for driving the LED 115 via the power circuit 110 switch Q1 based on the received signals. The power circuit control signals generated by the PWM generator are generated according to a switching scheme with a constant switching frequency, but with a variable duty cycle based on the dimmer output signal and the smaller of the two signals $V_1$ and $V_2$. As used herein, duty cycle refers to the fraction (often expressed as a percentage) of the switching period during which the power circuit control signals are configured to turn the power switch Q1 on. For example, a PWM switching scheme may have a switching frequency of 100 kHz, and accordingly a switching period of 10 μs. Hence, for a duty cycle of 30%, the power circuit control signals are configured to turn the power switch Q1 on for 3 μs and off for 7 μs of each switching period. The PWM generator duty cycle can be modulated as a linear function of the smaller of the two signals $V_1$ and $V_2$, and/or of the dimmer output signal 104.

The bandwidths of the filters 218 and 240 are adjusted based on changes in a desired dimmer level (such as an increase or decrease in brightness) and based on current loop operation. During operation in a first of the dimmer loop 200 or the CC loop 210 (the "active loop"), the bandwidth of the filter associated with a second of the two loops (the "inactive loop") is set to a pre-determined maximum. By maximizing the bandwidth of the filter of the inactive loop, the response time of the dimmer control circuit 110 upon switching operating loops is decreased, reducing potential overshoot or undershoot when switching between loops. Further, during stable operation in an active loop (operation without changes in dimmer level), the bandwidth of the filter associated with the active loop is set to a pre-determined minimum. By minimizing the bandwidth of the filter of the active loop during stable operation, noise is reduced on the driving signal of the active loop, thus reducing potential LED flickering and improving the performance of the LED 115.

In one embodiment, the voltage signal $V_{I_REF}$ is decreased by the CC reference module 245 during dimmer loop operation. For example, the voltage signal $V_{I_REF}$ is decreased by 10% in response to the switching from CC loop operation to dimmer loop operation by the dimmer control circuit 105. Upon switching from dimmer loop operation back to CC loop operation, the voltage signal $V_{I_REF}$ can be restored to 100% of the original $V_{I_REF}$ signal value. Reducing the reference voltage signal $V_{I_REF}$ during dimmer loop operation can help reduce overshoot when switching from dimmer loop operation to CC loop operation.

Figure 3:
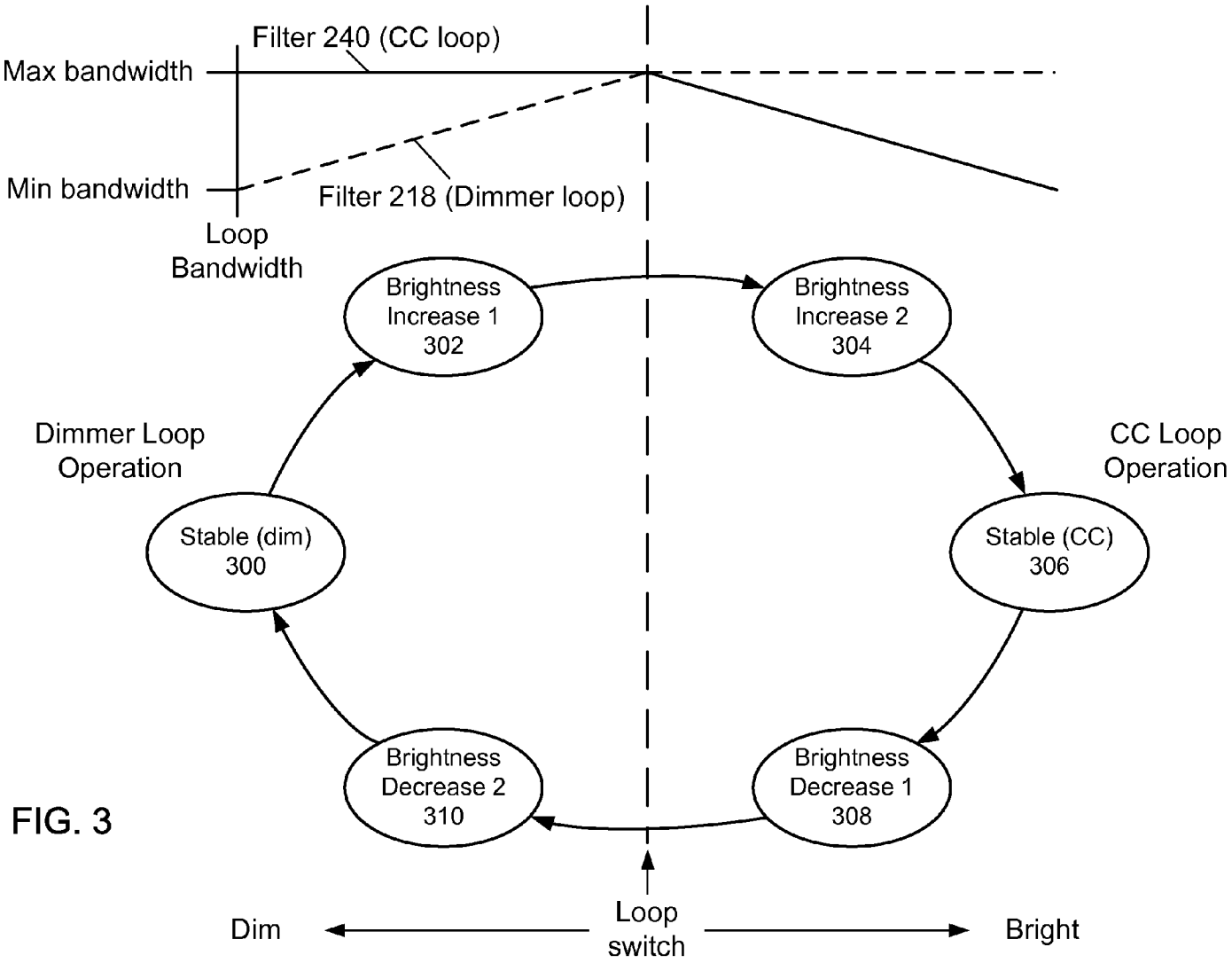
FIG. 3 illustrates loop bandwidth adjustment in conjunction with a dimming level transition table for a multi-loop dimmer control circuit, according to one embodiment.

FIG. 3 illustrates loop bandwidth adjustment in conjunction with a dimming level transition table for a multi-loop dimmer control circuit, according to one embodiment. The dimming level transition table of FIG. 3 illustrates six transition states, 300, 302, 304, 306, 308, and 310, though other embodiments may include other numbers of transition states. Shown in conjunction with the dimming level transition table is a filter bandwidth graph illustrating changes in bandwidth of filters 218 and 240 of FIG. 2 in conjunction with changes in dimming level.

The first transition state 300 of the transition table of FIG. 3 represents stable dimmer loop operation by the dimmer control circuit 105. During operation in transition state 300, the dimmer control circuit sets the bandwidth of the filter 218 to a first pre-determined minimum and sets the bandwidth of the filter 240 of the CC loop to a first pre-determined maximum. When an increase in requested brightness is received, the dimmer control circuit transitions to the second transition state 302. Upon transition to the second transition state, the dimmer control circuit maintains the bandwidth of the filter 240 at the first pre-determined maximum, and increases the bandwidth of the filter 218.

When the requested brightness continues to increase such that the dimmer control circuit 105 switches from dimmer loop operation to CC loop operation, the dimmer control circuit transitions to the third transition state 304. During the transition from the second transition state 302 to the third transition state, the dimmer control circuit increases the bandwidth of the filter 218 up to a second pre-determined maximum, timed to occur at or around the moment of switching from dimmer loop operation to CC loop operation. At or around the same time as the switch from dimmer loop operation to CC loop operation, the dimmer control circuit decreases the bandwidth of the filter 240 from the first pre-determined maximum.

When the requested brightness stops increasing, the dimmer control circuit 105 transitions to the fourth transition state 306, representing stable CC loop operation by the dimmer control circuit. During operation in the fourth transition state, the dimmer control circuit maintains the bandwidth of the filter 218 at the second pre-determined maximum, and decreases the bandwidth of the filter 240 to a second pre-determined minimum. It should be noted that although the first and the second pre-determined maximums are illustrated in FIG. 3 as the same maximum bandwidth, in other embodiments, the first and second maximum bandwidths are different bandwidths. Similarly, the first and the second pre-determined minimums can be different bandwidths. It should also be noted that in some embodiments, the pre-determined maximums and minimums may vary based on the current level of brightness of the LED 115.

Upon receiving a requested decrease in brightness, the dimmer control circuit 105 transitions to the fifth transition state 308. The dimmer control circuit maintains the bandwidth of the filter 218 at the second pre-determined maximum, and increases the bandwidth of the filter 240 from the second pre-determined minimum. Upon receiving additional requested decreases in brightness sufficient to cause the dimmer control circuit to switch from CC loop operation to dimmer loop operation, the dimmer control circuit transitions to the sixth transition state 310. During the transition from the fifth transition state to the sixth transition state, the dimmer control circuit increases the bandwidth of the filter 240 to the first pre-determined maximum, time to occur at or around the moment of switching from CC loop operation to dimmer loop operation. At or around the same time as the switch from CC loop operation to dimmer loop operation, the dimmer control circuit decreases the bandwidth of the filter 218 from the second predetermined maximum.

When the requested brightness stops decreasing, the dimmer control circuit 105 transitions from the sixth transition state 310 to the first transition state 300, representing stable dimmer loop operation by the dimmer control circuit. Accordingly, the dimmer control circuit decreases the bandwidth of the filter 218 to the first pre-determined minimum, and maintains the bandwidth of the filter 240 at the first pre-determined maximum.

It should be noted that in some embodiments, the dimmer control circuit 105 can transition between states in orders other than those described herein. For instance, if the dimmer control circuit is operating in stable dimmer loop operation (transition state 300), an increase in requested brightness may cause the dimmer control circuit to transition to transition state 302 (and accordingly, increase the bandwidth of filter 218) only if the increase in requested brightness exceeds a pre-determined threshold. Similarly, if the dimmer control circuit is operating in stable CC loop operation (transition state 306), a decrease in requested brightness may cause the dimmer control circuit to transition to transition state 308 (and accordingly, increase the bandwidth of filter 240) only if the decrease in requested brightness exceeds a pre-determined threshold.

In one embodiment, upon transitioning to transition state 302 from transition state 300 (in response to receiving an increase in requested brightness), the dimmer control circuit 105 may transition back to transition state 300 if 1) further increases in requested brightness are not received, 2) if the previously received increase in requested brightness is not sufficient to cause the dimmer control circuit to switch from dimmer loop operation to CC loop operation, and/or 3) if a decrease in brightness is received while still operating in dimmer loop operation. In such an embodiment, upon transitioning from transition state 302 back to transition state 300, the dimmer control circuit may reduce the bandwidth of the filter 218 to the first pre-determined minimum. Similarly, upon transitioning to transition state 308 from transition state 306 (in response to receiving a decrease in requested brightness), the dimmer control circuit may transition back to transition state 306 if 1) further decreases in requested brightness are not received, 2) if the previously received decrease in requested brightness is not sufficient to cause the dimmer control circuit to switch from CC loop operation to dimmer loop operation, and/or 3) if an increase in brightness is received while still operating in CC loop operation. In such an embodiment, upon transitioning from transition state 308 back to transition state 306, the dimmer control circuit may reduce the bandwidth of the filter 240 to the second pre-determined minimum.

In one embodiment, the dimmer control circuit 105 may operate in transition state 300 at a brightness level very close to the loop switching point (in other words, at a brightness such that very small increases in requested brightness may cause the dimmer control circuit to switch to CC loop operation). In such an embodiment, upon receiving a requested increase in brightness, the dimmer control circuit may transition from transition state 300 directly to transition state 304, and may very quickly increase the bandwidth of the filter 218 to the second pre-determined maximum and decrease the bandwidth of the filter 240 from the first pre-determined maximum. Similarly, the dimmer control circuit may operate in transition state 306 at a brightness level very close to the loop switching point (where a small decrease in requested brightness may cause the dimmer control circuit to switch to dimmer loop operation). In such an embodiment, upon receiving a requested decrease in brightness, the dimmer control circuit may transition from transition state 306 directly to transition state 310, and may very quickly increase the bandwidth of the filter 240 to the first pre-determined maximum, and decrease the bandwidth of the filter 218 from the second pre-determined maximum.

The rate at which the dimmer control circuit 105 increases and decreases the bandwidths of filters 218 and 240 can be substantially constant/linear, or can vary based on current operating parameters. For example, the dimmer control circuit can increase the bandwidth of filter 218 from the first pre-determined minimum bandwidth at twice the rate that the dimmer control circuit increases the bandwidth of filter 240. Similarly, the dimmer control circuit can decrease the bandwidth of filter 218 at a rate twice as fast as the rate that the dimmer control circuit decreases the bandwidth of filter 240. The increase and decrease in filter bandwidths can be based on the rate at which increases and/or decreases in brightness are received, can be based on the current brightness of the LED 115, can be based on the active loop, or can be based on any other factor associated with the operation of the dimmer control circuit. In one embodiment, increases and decreases in filter bandwidth is substantially smooth in order to reduce noise.

Figure 4:
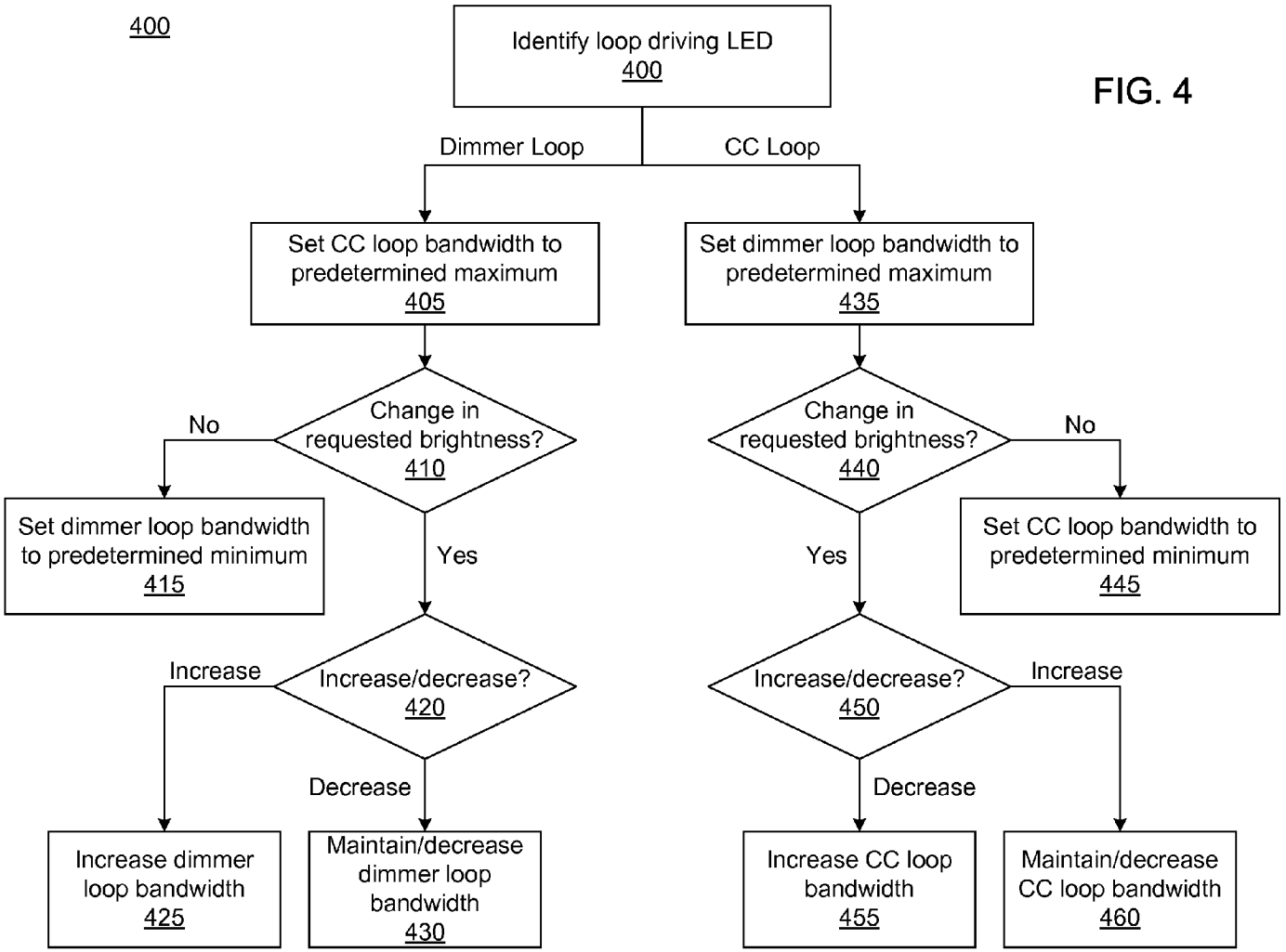
FIG. 4 illustrates a flow chart of a process for adjusting loop bandwidth in a multi-loop dimmer control circuit, according to one embodiment.

FIG. 4 illustrates a flow chart of a process for adjusting loop bandwidth in a multi-loop dimmer control circuit, according to one embodiment. The steps of the process described herein are performed by the dimmer control circuit 105. It should be noted that FIG. 4 illustrates the process for a single loop bandwidth adjustment; in practice, a system implementing the process of FIG. 4 will iteratively set and adjust loop filter bandwidths as system operating parameters change over time. A loop driving an LED (an active loop) is identified 400 in a multi-loop dimmer control circuit. In the embodiment described herein, the multi-loop dimmer control circuit includes a dimmer loop and a CC loop, though in other embodiments, the dimmer control circuit can include additional or different loops.

If the identified active loop is the dimmer loop, the CC loop bandwidth is set 405 to a first predetermined maximum. If no requested change in LED brightness is detected 410 (representing stable dimmer loop operation), then the dimmer loop bandwidth is set 415 to a first predetermined minimum. Upon detecting 420 a request for an increase in LED brightness, the dimmer loop bandwidth is increased 425. Upon detecting 420 a request for a decrease in brightness, the dimmer loop bandwidth is decreased if the current dimmer loop bandwidth is greater than the first predetermined minimum, and maintained if the current dimmer loop bandwidth is equal to the first predetermined minimum.

If the identified active loop is the CC loop, the dimmer loop bandwidth is set 435 to a second predetermined maximum. If no requested change in LED brightness is detected 440, then the CC loop bandwidth is set 445 to a second predetermined minimum. Upon detecting 450 a request for an decrease in LED brightness, the CC loop bandwidth is increased 455. Upon detecting 420 a request for an increase in LED brightness, the CC loop bandwidth is decreased if the current CC loop bandwidth is greater than the second predetermined minimum, and maintained if the current CC loop bandwidth is equal to the second predetermined minimum.

Upon reading this disclosure, those of skill in the art will appreciate still additional alternative designs for controlling the dimming operation of an LED. Thus, while particular embodiments and applications have been illustrated and described, it is to be understood that the embodiments discussed herein are not limited to the precise construction and components disclosed herein and that various modifications, changes and variations which will be apparent to those skilled in the art may be made in the arrangement, operation and details of the method and apparatus disclosed herein without departing from the spirit and scope of the disclosure.

What is claimed is:

1. An LED dimmer control circuit comprising:

a dimmer loop configured to receive a dimmer output signal from a dimmer switch, and to generate a first loop signal representative of the dimmer output signal, the dimmer loop comprising a first filter;

a constant current loop configured to receive a sense signal representing a load current through an LED coupled to the dimmer control circuit and a reference signal representing a full load current through the LED, and to generate a second loop signal representative of a comparison of the sense signal and the reference signal, the constant current loop comprising a second filter; and a pulse-width modulation generator configured to generate control signals for the LED based on a smaller of the first loop signal and the second loop signal;

wherein the bandwidth of the first filter is set to a first predetermined maximum in response to the second loop signal being smaller than the first loop signal;

wherein the bandwidth of the second filter is set to a second predetermined maximum in response to the first loop signal being smaller than the second loop signal.

2. The LED dimmer control circuit of claim 1, wherein the dimmer output signal represents a desired level of dimming set via the dimmer switch.

3. The LED dimmer control circuit of claim 2, wherein the dimmer loop further comprises a dimmer processor configured to:

detect an amount of phase modulation within the dimmer output signal;

generate a dimming phase signal representative of the detected amount of phase modulation; and determine a dimming ratio based on the dimming phase signal, the dimming ratio representing a faction of power to deliver to the LED to achieve the desired level of dimming;

wherein the first loop signal comprises the dimming ratio.

4. The LED dimmer control circuit of claim 1, wherein the constant current loop further comprises a PI controller configured to:

determine a difference between the sense signal and the reference signal; and generate an amplified signal based on the determined difference;

wherein the second loop signal comprises the amplified signal.

5. The LED dimmer control circuit of claim 1, wherein generating control signals comprises generating pulses with a duty cycle based on the smaller of the first loop signal and the second loop signal.

6. The LED dimmer control circuit of claim 1, further comprising a multiplexor configured to receive the first loop signal at a first input line, to receive the second loop signal at a second input line, to receive a select signal at a select line from a comparator configured to output the select signal based on the smaller of the first loop signal and the second loop signal, and to output the smaller of the first loop signal and the second loop signal based on the received select signal.

7. The LED dimmer control circuit of claim 1, wherein the first filter is set at a bandwidth lower than the first predetermined maximum in response to the first loop signal being smaller than the second loop signal, and wherein the second filter is set at a bandwidth lower the second predetermined maximum in response to the second loop signal being smaller than the first loop signal.

8. An LED dimmer control circuit comprising:

a first loop comprising a first filter and configured to output a first loop signal based on a received dimmer signal, the first filter comprising a configurable bandwidth filter;

a second loop comprising a second filter and configured to output a second loop signal based on a reference signal representing an LED at full load, the second filter comprising a configurable bandwidth filter; and a signal generator configured to generate LED driver signals for the LED based on a loop signal associated with a loop driving the signal generator;

wherein the first loop drives the signal generator when the first loop signal is smaller than the second loop signal;

wherein the second loop drives the signal generator when the second loop signal is smaller than the first loop signal.

9. The LED dimmer control circuit of claim 8, wherein the first filter and the second filter comprise low-pass filters.

10. The LED dimmer control circuit of claim 8, wherein the first filter is set to a first bandwidth when the second loop is driving the signal generator, and to a bandwidth less than the first bandwidth when the first loop is driving the signal generator.

11. The LED dimmer control circuit of claim 10, wherein the bandwidth of the first filter is increased in response to the received dimmer signal indicating an increase in LED brightness.

12. The LED dimmer control circuit of claim 11, wherein the bandwidth of the first filter is increased up to the first bandwidth in response to the received dimmer signal causing a switch in the loop driving the signal generator from the first loop to the second loop.

13. The LED dimmer control circuit of claim 8, wherein the second filter is set to a second bandwidth when the first loop is driving the signal generator, and to a bandwidth less than the second bandwidth when the second loop is driving the signal generator.

14. The LED dimmer control circuit of claim 13, wherein the bandwidth of the second filter is increased in response to the received dimmer signal indicating a decrease in LED brightness.

15. The LED dimmer control circuit of claim 14, wherein the bandwidth of the second filter is increased up to the second bandwidth in response to the received dimmer signal causing a switch in the loop driving the signal generator from the second loop to the first loop.

16. The LED dimmer control circuit of claim 8, wherein the first a bandwidth of the first filter and a bandwidth of the second filter comprise the same bandwidth.

17. A method of adjusting filter bandwidth in a multi-loop LED dimmer control circuit comprising:

receiving a dimmer output signal representing a desired LED brightness, wherein a first loop in the dimmer control circuit generates a first loop signal representative of the dimmer output signal, the first loop comprising a first filter;

receiving a reference signal representing a full load current through an LED, wherein a second loop in the dimmer control circuit generates a second loop signal representative of the reference signal, the second loop comprising a second filter;

in response to the first loop signal being smaller than the second loop signal, setting the first filter to a first bandwidth less than a first pre-determined maximum bandwidth and setting the second filter to a second pre-determined maximum bandwidth; and in response to the second loop signal being smaller than the first loop signal, setting the first filter to the first pre-determined maximum bandwidth and setting the second filter to a second bandwidth less than the second pre-determined maximum bandwidth.

18. The method of claim 17, wherein the first loop signal is smaller than the second loop signal, and further comprising:

receiving a second dimmer output signal representing a desired increase in LED brightness, wherein the first loop generates an updated first loop signal representative of the second dimmer output signal;

in response to the updated first loop signal being smaller than the second loop signal, increasing the bandwidth of the first filter to a third bandwidth less than the first pre-determined maximum bandwidth; and in response to the second loop signal being smaller than the updated first loop signal, increasing the bandwidth of the first filter to the first pre-determined maximum bandwidth and decreasing the bandwidth of the second filter to a fourth bandwidth less than the second pre-determined maximum bandwidth.

19. The method of claim 17, wherein the second loop signal is smaller than the first loop signal, and further comprising:

receiving a second dimmer output signal representing a desired decrease in LED brightness, wherein the first loop generates an updated first loop signal representative of the second dimmer output signal;

in response to the second loop signal being smaller than the updated first loop signal, increasing the bandwidth of the second filter to a fifth bandwidth less than the second pre-determined maximum bandwidth; and in response to the updated first loop signal being smaller than the second loop signal, increasing the bandwidth of the second filter to the second pre-determined maximum bandwidth and decreasing the bandwidth of the first filter to a sixth bandwidth less than the first pre-determined maximum bandwidth.

* * * * *